US007744495B2

(12) United States Patent
Lipidarov

(10) Patent No.: US 7,744,495 B2
(45) Date of Patent: Jun. 29, 2010

(54) GOLF MAT APPARATUS

(76) Inventor: Nicholas Lipidarov, 11224 Linden La., Port Richey, FL (US) 34668

( * ) Notice: Subject to any disclaimer, the term of this patent is extended or adjusted under 35 U.S.C. 154(b) by 197 days.

(21) Appl. No.: 11/804,812

(22) Filed: May 21, 2007

(65) Prior Publication Data

US 2008/0293509 A1 Nov. 27, 2008

(51) Int. Cl.
*A63B 69/36* (2006.01)

(52) U.S. Cl. ..... 473/387; 473/278

(58) Field of Classification Search ..... 473/387–403, 473/278

See application file for complete search history.

(56) References Cited

U.S. PATENT DOCUMENTS 1,936,625 A * 11/1933 Goldman ..... 473/398
2,370,529 A * 2/1945 Fuller ..... 473/396
2,661,213 A * 12/1953 Barnard ..... 473/394
2,815,953 A * 12/1957 West ..... 473/278
3,516,664 A * 6/1970 Brennan ..... 473/278
3,599,982 A * 8/1971 Elesh ..... 473/278
4,844,470 A * 7/1989 Hammon et al. ..... 473/278
4,902,541 A * 2/1990 Martino ..... 428/17
5,026,580 A * 6/1991 Hammon ..... 473/278
5,156,403 A * 10/1992 Martino ..... 473/278
5,170,604 A * 12/1992 Hedly ..... 52/584.1
5,492,323 A * 2/1996 Lee ..... 473/278
5,645,494 A * 7/1997 Dionne et al. ..... 473/278
5,766,100 A * 6/1998 Dilmore ..... 473/396
6,659,775 B1 * 12/2003 Moy ..... 473/387
7,384,353 B2 * 6/2008 Lipidarov ..... 473/392
2006/0035728 A1 * 2/2006 Chang ..... 473/387
2007/0167259 A1 * 7/2007 Lipidarov ..... 473/387
2007/0202966 A1 * 8/2007 Lipidarov ..... 473/387

* cited by examiner

*Primary Examiner*—Steven Wong
(74) *Attorney, Agent, or Firm*—Ronald E. Smith; Smith & Hopen, P.A.

(57) ABSTRACT

A golf mat for holding multiple tees for golf practice. The mat has a foam bottom in underlying relation to an artificial turf into which is formed a plurality of recesses each of which is adapted to accommodate a golf tee that lies in the recess, placing it out of the path of a golf club. This provides a longer lasting mat and golf tee combination.

8 Claims, 17 Drawing Sheets

GOLF MAT APPARATUS

BACKGROUND OF THE INVENTION

1. Field of the Invention

This invention relates, generally, to golf mats. More particularly, it relates to a golf mat that houses a plurality of golf tees. It also includes a golf tee connector or insert that holds the tee in the mat.

2. Description of the Prior Art

Some golf mats have training lines to follow as disclosed in U.S. Pat. No. 5,645,494 to Dionne. Some swivel as disclosed in U.S. Pat. No. 5,156,398 to Kibamoto.

The known mats are used with conventional tees that are mounted under the mat and which extend upwardly through a tee-accommodating opening formed in the mat. This makes the mat vulnerable because a golf club can strike the opening where the tee extends through the mat and tears the mat around the opening. Repeatedly striking the tee also creates a huge resistance to the golf club. Therefore, when the club strikes the tee it catches the tee and starts to open and tear the hole. Accordingly, the mat tears around the hole long before the top of the mat is worn out.

U.S. Pat. No. 4,902,541 to Martino discloses an improved mat structure that includes addition of a stronger section around the tee-accommodating opening, thereby providing a longer playing time before the mat tears. However, the Martino improvement does not totally solve the problem of the mat tearing around the hole.

SUMMARY OF THE INVENTION

The present invention discloses a golf mat structure having a recess to allow a golf tee to set inside the recess to remove the tee from the path of the golf club and enabling the golf tee to connect to the mat with a golf tee connector. The improved mat houses the golf tee out of harms way by lowering it into the mat. Putting the golf tee under the top of the mat makes it harder to hit the base to snag it or pull it with the club. This feature keeps the base of the tee flush with the top of the mat and prevents the tee from being struck on its base by a golf club.

The novel tee includes a golf tee connector to connect to it to the mat so that the tee and mat are one apparatus. The golf tee is height-adjustable. It has a flexible base that has minimal resistance because it flexes in the direction it is struck, thereby giving the player a smoother swing. The novel tee quickly returns to its position of repose after being struck. This feature enables the tee to last longer than any tee that comes up from the bottom of the mat. This prevents having to repeatedly replace the tee, thereby saving time and money.

Indentions formed in the bottom of the tee enable the tee to flex in ideal locations when struck by a golf club, thereby allowing a smoother swing with no interruptions from the base of the tee coming up and pushing on the club as it passes through the tee. The shape of the tee allows it to maintain its stationary position when struck and still allows a person to hit the tee at an angle so that the tee can flex side to side vigorously when struck at an improper angle.

The golf tee connector connects the tee to the mat without mat rotation and also keeps the tee from rotating with respect to the mat as well. The golf tee connector adjusts to many different heights. It easily and quickly connects to the mat and tee with no complex parts, and also interlocks with itself to eliminate rotation.

A second embodiment includes a novel step tee that enables a user to slip the novel tee through an insert in the mat.

This is an easy slip in design that is quick and simple to connect to the mat and replace when needed. This embodiment of the tee does not need a golf tee connector to connect it to the mat. This tee also saves time and money relative to the costly replacement of conventional tees that come up from the bottom of the mat. This embodiment of the novel tee has the same structural features on the top most part of the tee as the first embodiment of the tee and enables a golfer to gain the same ease and smooth swing path. This embodiment of the tee has an extra vertical step down and a lower continuation of the base to help in holding the tee to the mat when connected and slipped through the insert.

A novel insert pushes into the mat and allows the tee to extend through the mat. The insert reinforces the section around the mat where the tee goes through to help prevent the mat from ripping apart. The insert holds the tee in the correct place and keeps it from rotating and coming out of the mat when struck by a golf club.

In accordance with the present invention a golf mat apparatus comprises a mat that has a recessed shape in the top to house a golf tee that connects with a golf tee connector or a golf tee that connects through an insert that holds the golf tee so it can be struck by a golf club and that enables it to come back into place and to place it out of the direct path of a golf club to obtain a free flowing swing with no catching the tee for improved golf practice.

DETAILED DESCRIPTION OF THE PREFERRED EMBODIMENT

Figure 1:
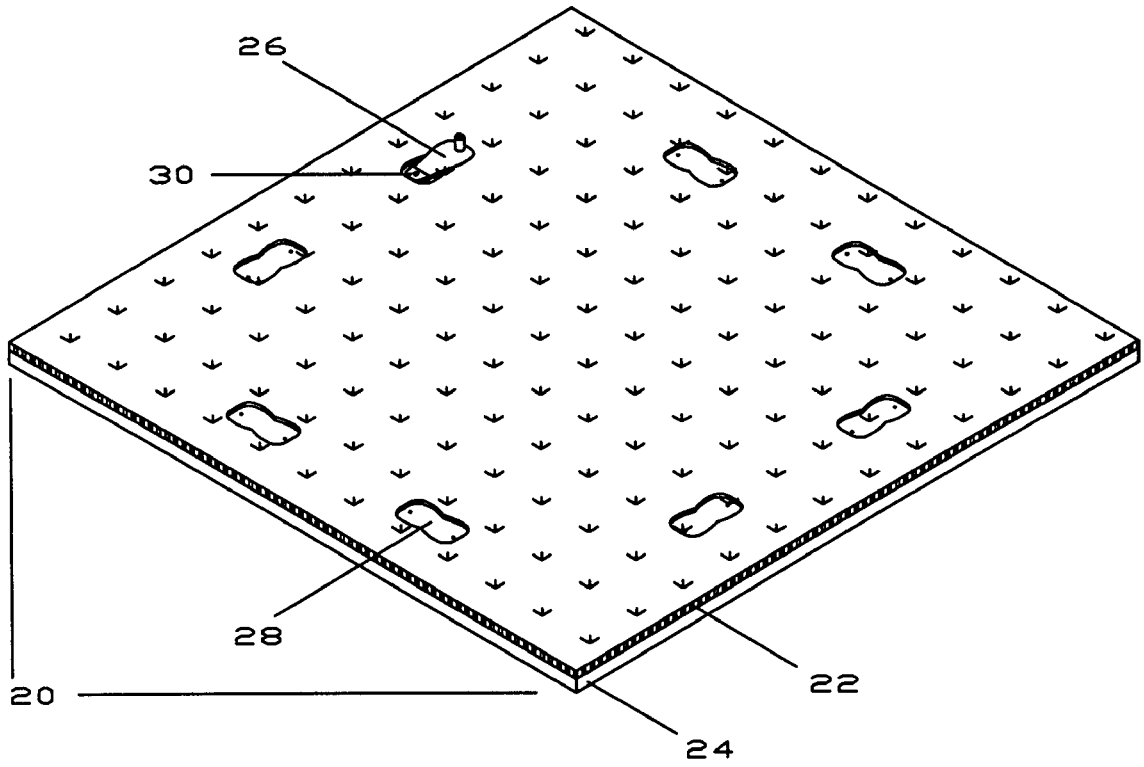
FIG. 1 is a perspective view of a novel golf mat.

A preferred embodiment of the golf mat apparatus of the present invention is illustrated in FIG. 1. Mat 20 has a foam base 24. Artificial turf 22 overlies base 24. Recess 28 accommodates elongate, flexible flat base 26 and connector 30.

Figure 2:
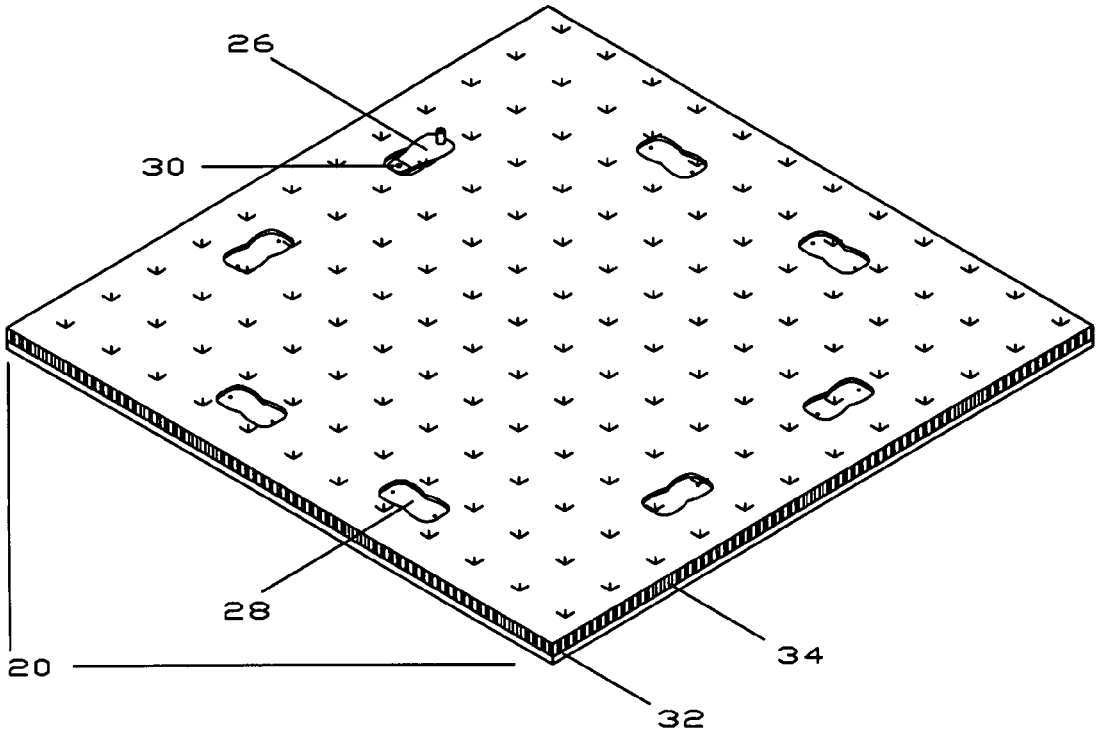
FIG. 2 is a perspective view of a mat that has a bottom base with longer artificial turf than the mat of FIG. 1.

FIG. 2 differs from FIG. 1 only to the extent that artificial turf 22 has a greater length than the artificial turf of the FIG. 1 embodiment. Foam base 24 may also be thicker or thinner than the foam base of FIG. 1.

Figure 3:
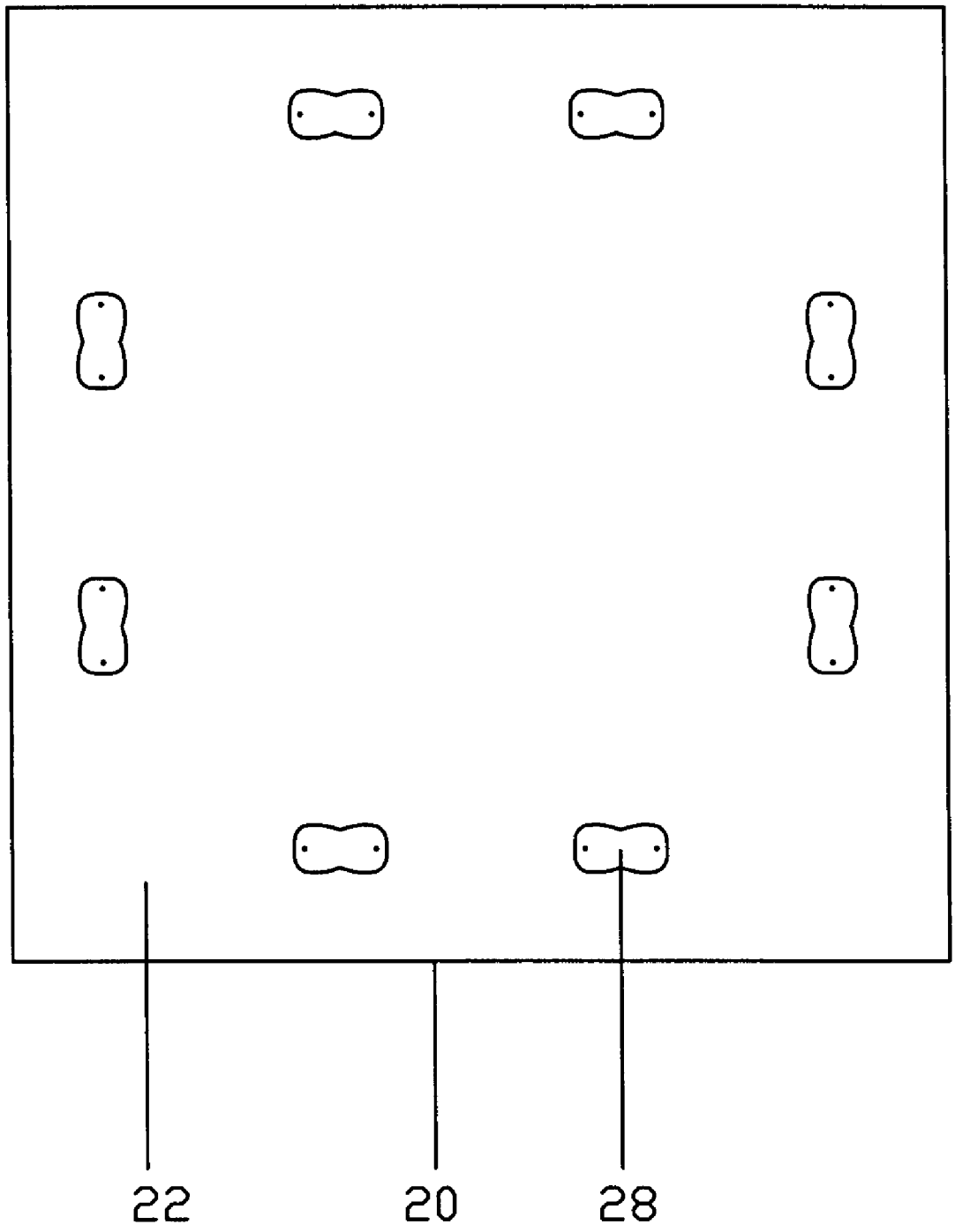
FIG. 3 is a top plan view of the novel mat.

FIG. 3 is a top plan view of mat 20 having recesses 28 formed in artificial turf 22.

Figure 4:
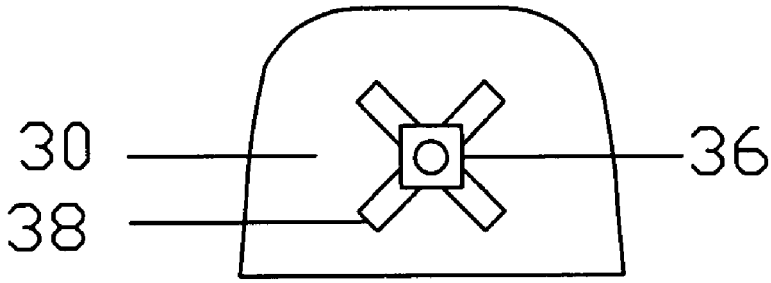
FIG. 4 is a bottom plan view of a top part of a connector.

FIG. 4 is a bottom plan view of the top part of a novel golf tee connector. Square part 36 engages the bottom part of the connector and keeps it from rotating. X-shaped part 38 holds the golf tee and keeps the golf tee from rotating.

Figure 5:
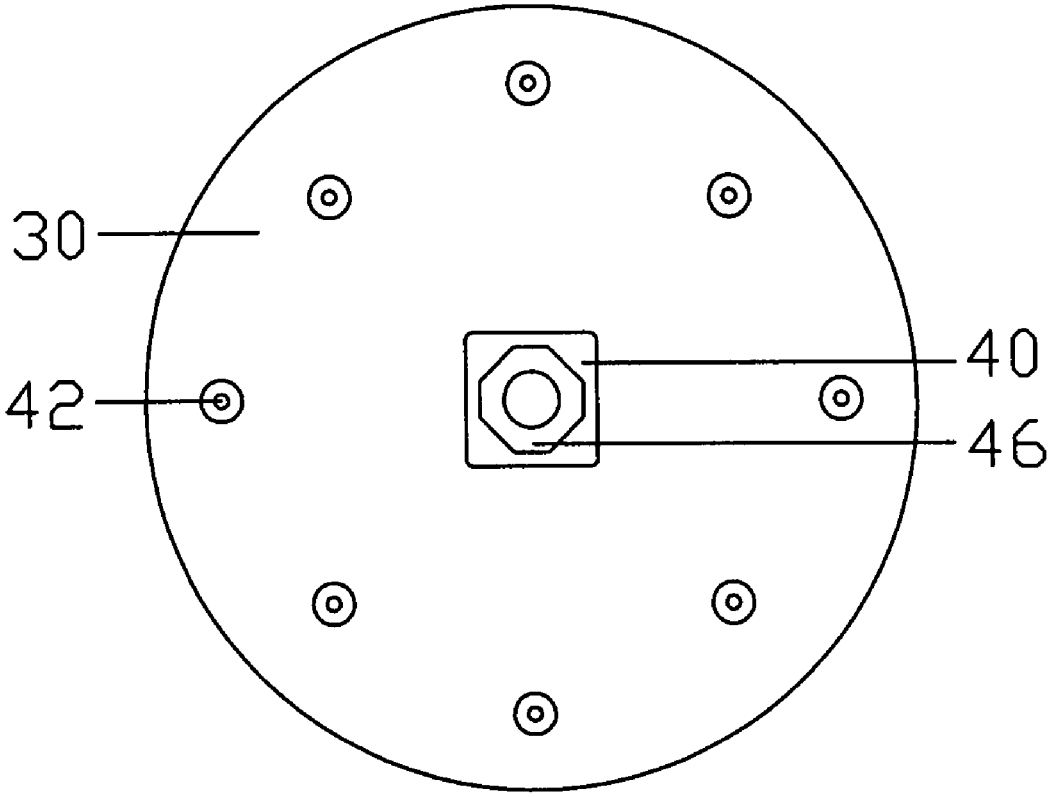
FIG. 5 is a top plan view of a bottom part of the connector.

FIG. 5 is a top plan view of the base of the golf tee connector. Square part 40 engages the top part of the connector to keep it from rotating. Spikes 42 keep the base of connector 30 from rotating when connected under the mat. Nut 46 on the bottom of the connector screwthreadedly engages bolt 44, depicted in FIG. 6, to hold the parts of connector 30 together.

Figure 6:
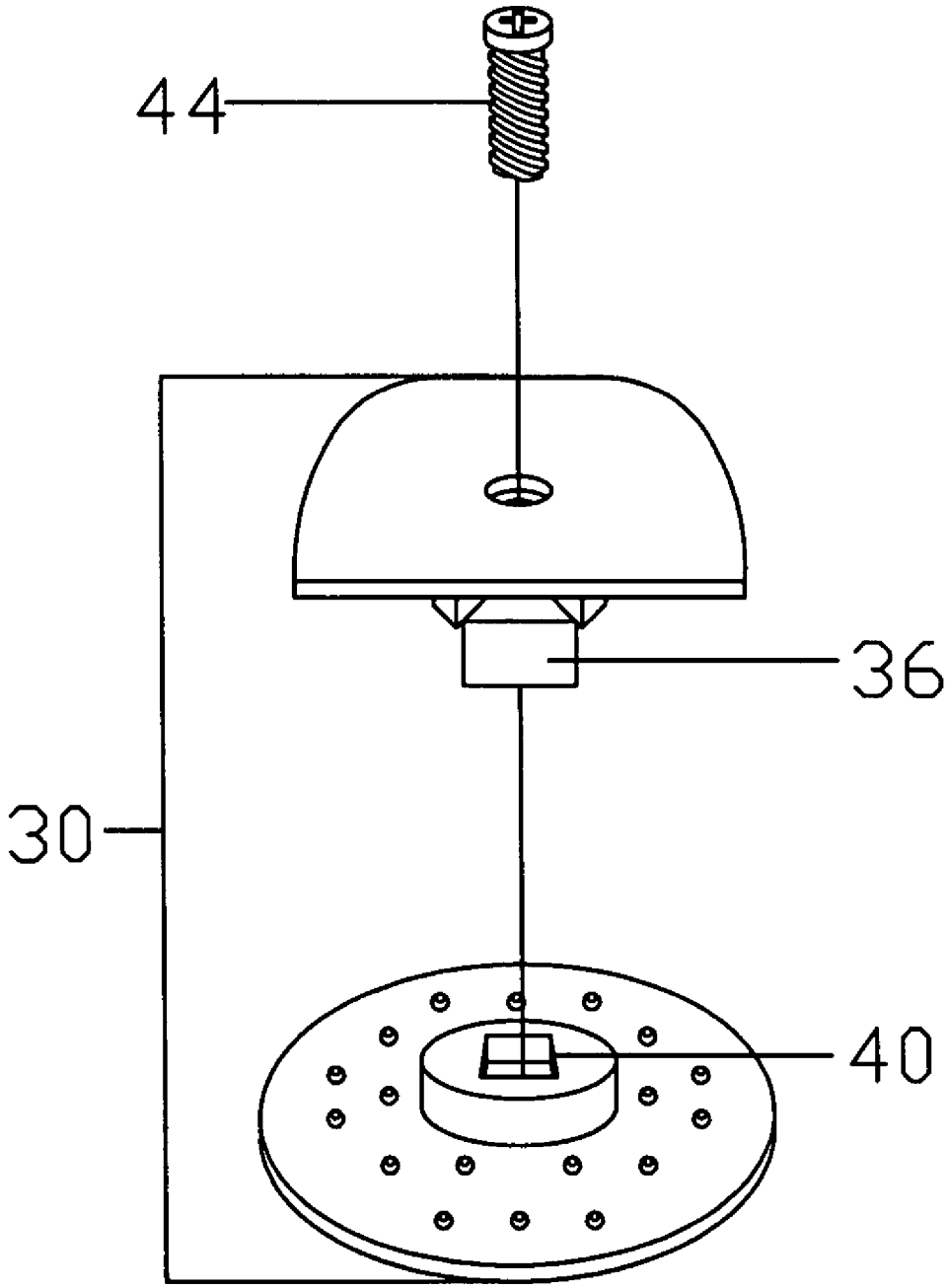
FIG. 6 is an exploded perspective view of the golf tee connector that holds the tee to the mat.

FIG. 6 is an exploded view of golf tee connector 30. Bolt 44 holds the top and base of golf tee connector 30 together as aforesaid.

Figure 7:
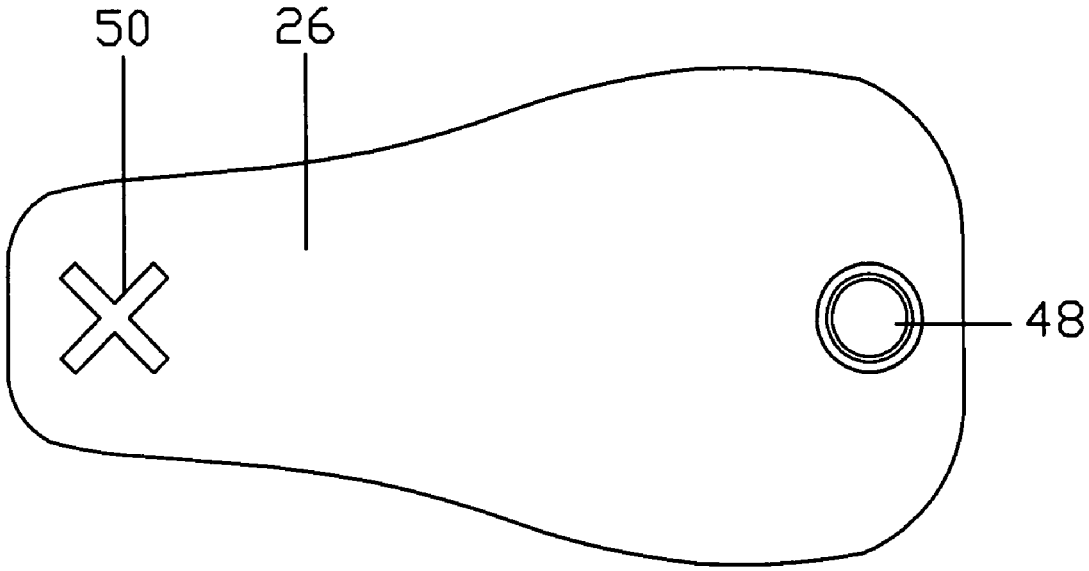
FIG. 7 is a top plan view of the golf tee used in connection with the novel mat.

FIG. 7 is a top plan view of elongate, flexible flat base 26 including cylinder stem 48 and X-shaped cutout 50 that accommodates golf tee connector 30 to hold the tee in place and keep it from rotating.

Figure 8:
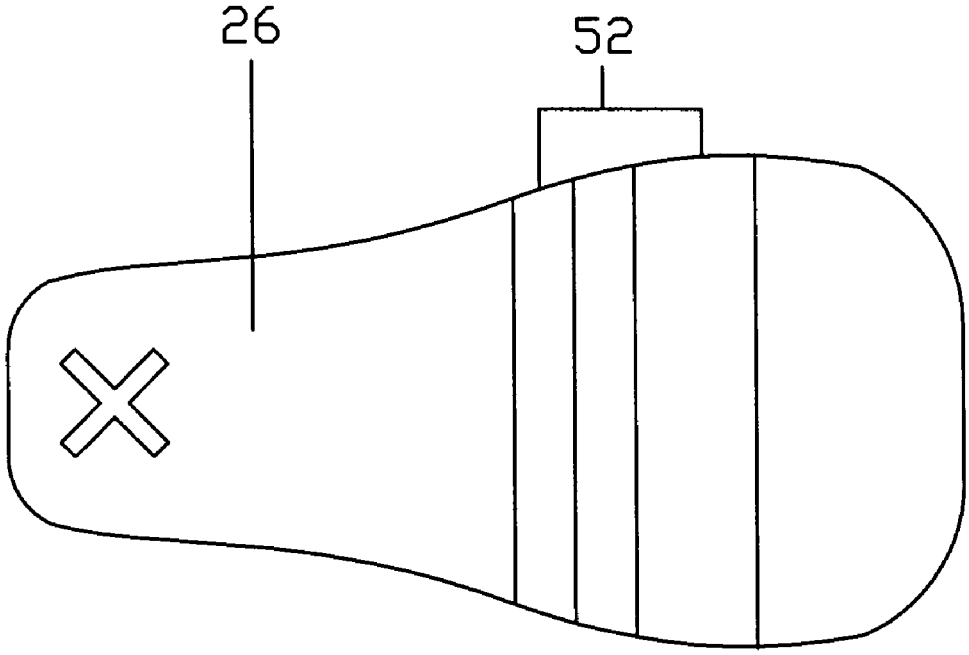
FIG. 8 is a bottom plan view of said golf tee.

FIG. 8 is a bottom plan view of elongate, flexible flat base 26. Two indentations 52 enable golf tee 26 to flex in ideal locations to allow for a smoother swing that is uninterrupted by the base hitting the bottom of the golf club as it passes through the tee.

Figure 9:
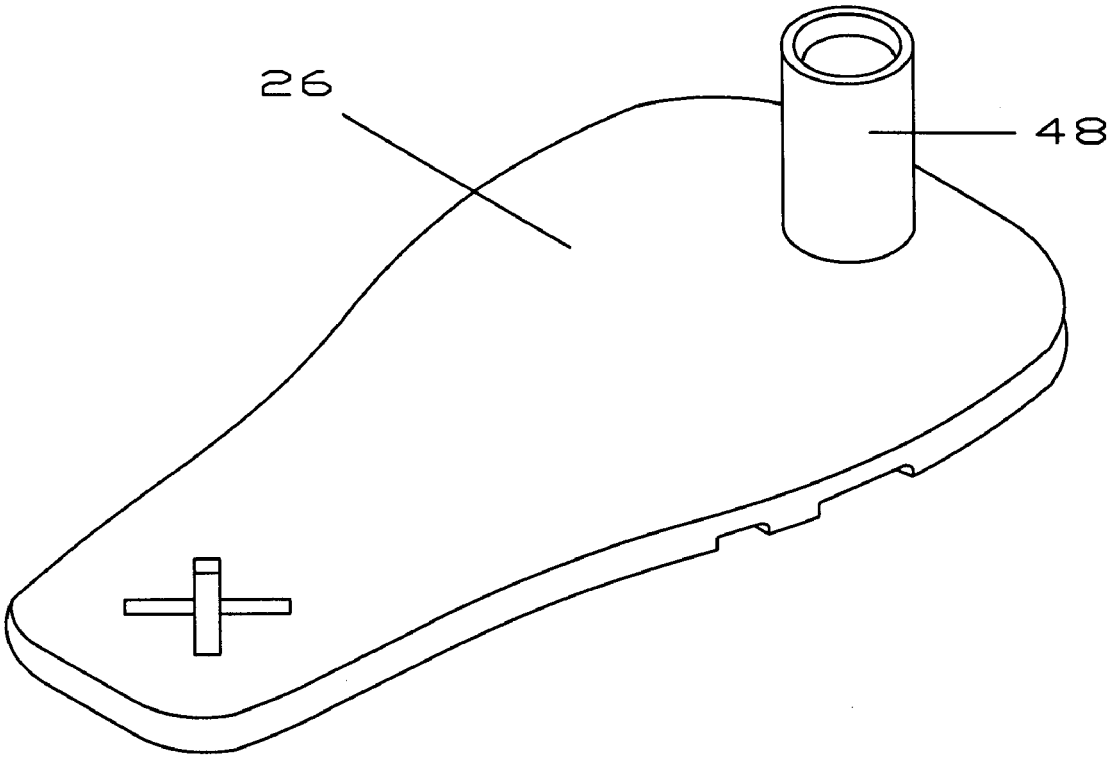
FIG. 9 is a perspective view of said golf tee.

FIG. 9 is a perspective view of elongate, flexible flat base 26. Upstanding cylindrical stem 48 supports a golf ball.

Figure 10:
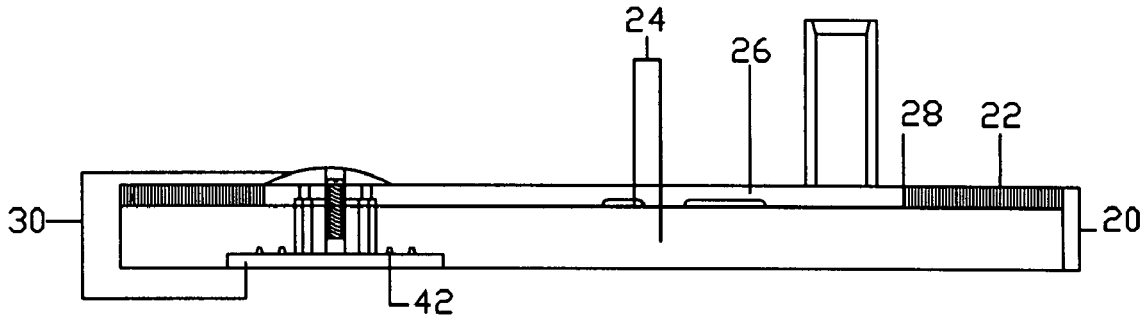
FIG. 10 is a longitudinal cross-sectional view taken along line 10-10 in FIG. 1.

FIG. 10 is a cross-sectional view of mat 20 having foam bottom 24, artificial turf 22, and recess 28 to house elongate, flexible flat base 26 that is attached to mat 20 by golf tee connector 30 having spikes 42 formed on its base to keep said golf tee connector 30 from rotating with the tee.

Figure 11:
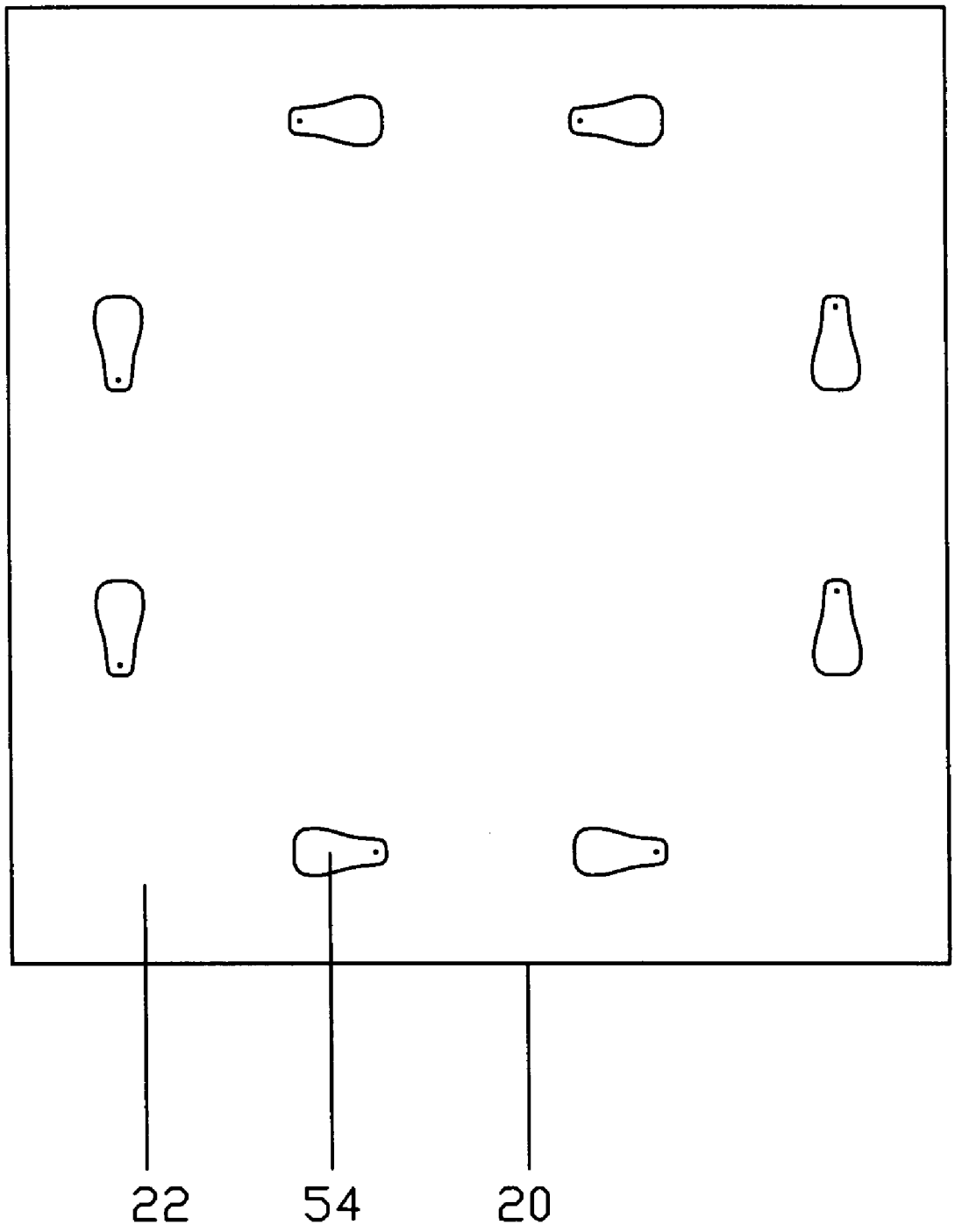
FIG. 11 is a top plan view of the novel mat when configured for right handed players.

FIG. 11 is a top plan view of an embodiment of mat 20 having right handed recesses 54 formed in artificial turf 22.

Figure 12:
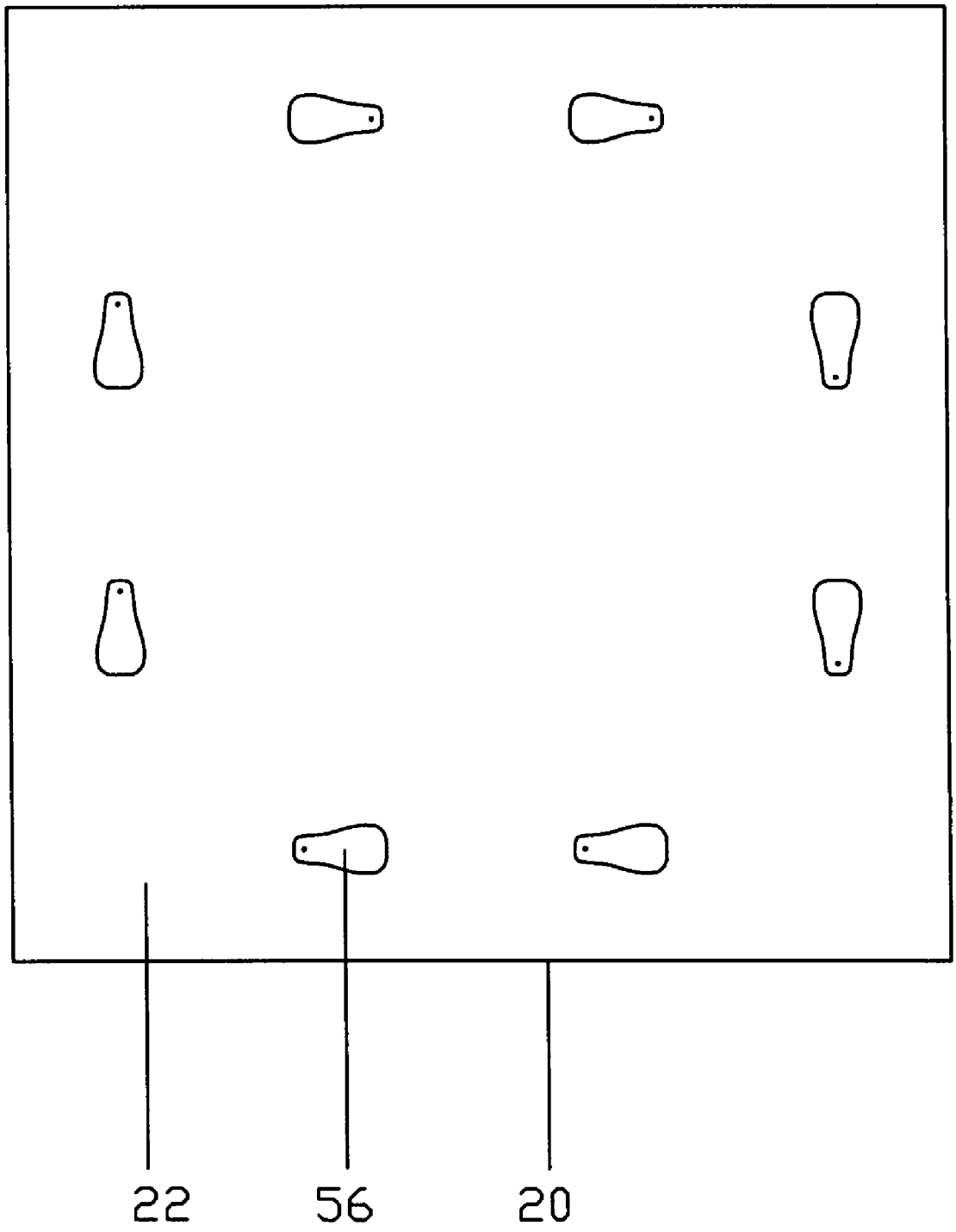
FIG. 12 is a top plan view of the novel mat when configured for left handed players.

FIG. 12 is a top plan view of an embodiment of mat 20 having left handed recesses 56 formed in artificial turf 22.

Figure 13:
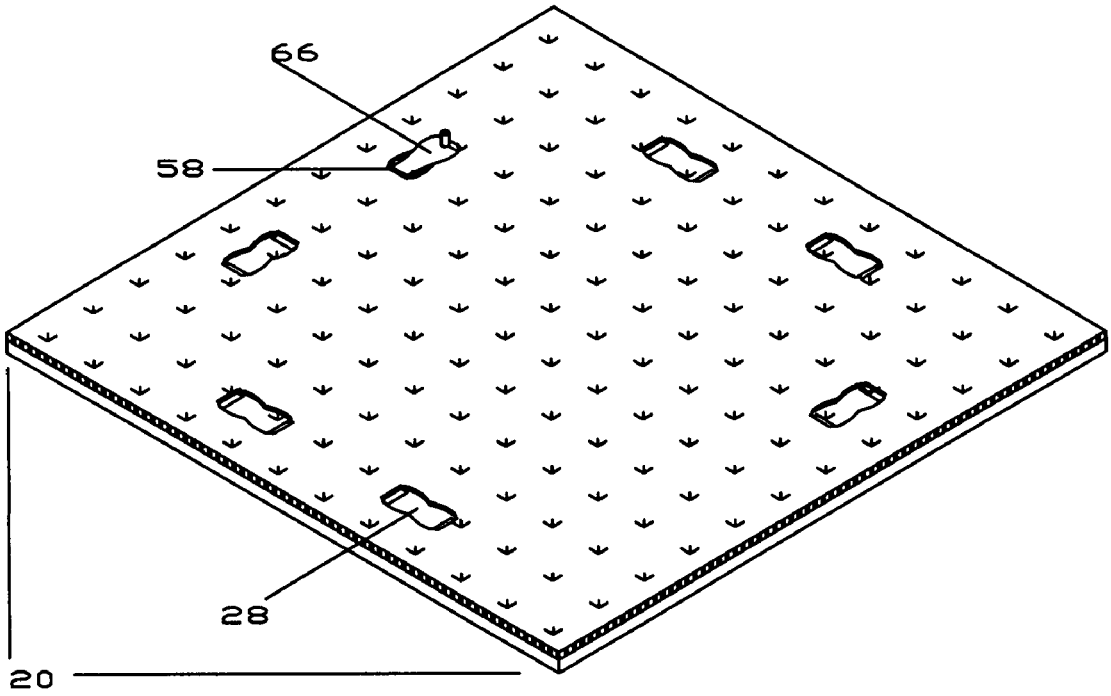
FIG. 13 is a perspective view of the novel mat and an embodiment of golf tees that slip through an insert formed in the mat.
Figure 18:
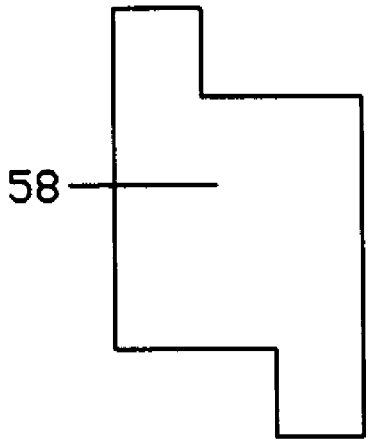
FIG. 18 is a side elevational view of the novel insert.
Figure 19:
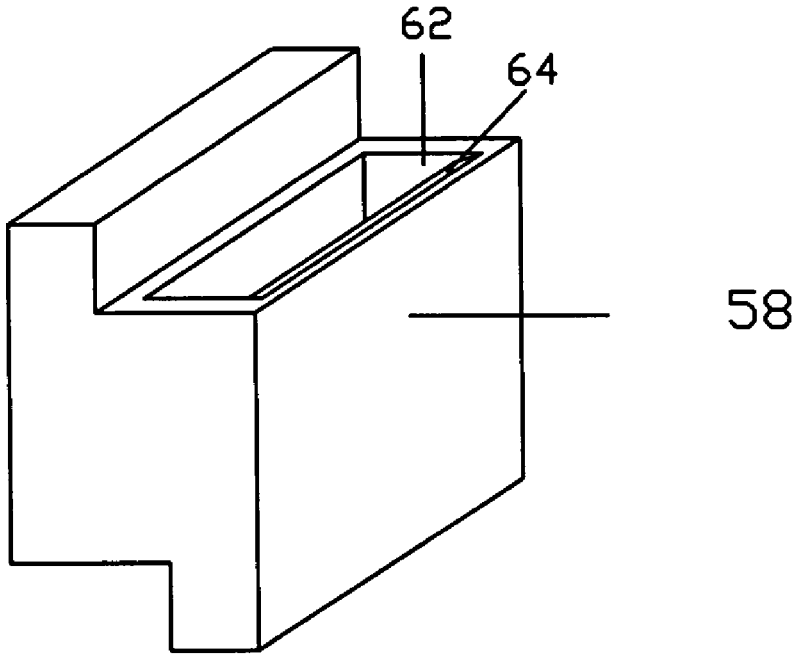
FIG. 19 is a perspective view of the insert.

FIG. 13 is a perspective view of mat 20 having a plurality of recesses 28 formed therein, each of which enables a step golf tee 66 to penetrate mat 20 through insert 58, depicted in FIGS. 18 and 19, that is positioned in mat 20. Insert 58 enables each tee 66 to sit level with the top of the mat out of harm's way.

Figure 14:
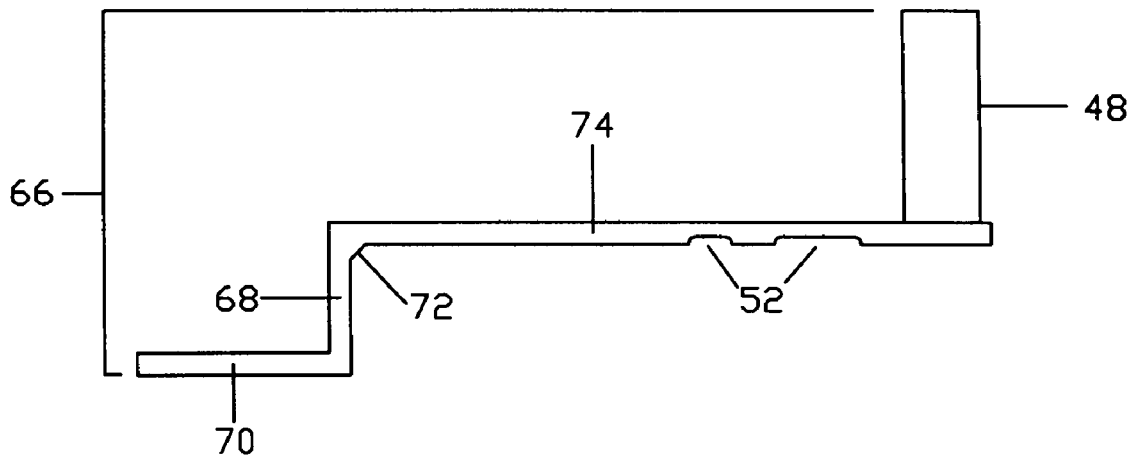
FIG. 14 is a side elevational view of a step golf tee that slips through the insert formed in the mat.

FIG. 14 is a side elevational view of step golf tee 66. It has lower base 70 formed integrally with vertical wall 68 that is formed integrally with horizontal top wall 74 to which golf-ball-supporting upstanding cylinder stem 48 is mounted. Outer bevel 72 gives the step golf tee 66 sufficient strength to snap it back into place when the top of step golf tee 66 is struck by a golf club. When a golf club strikes step golf tee 66, it flexes in two locations that are formed on an underside of wall 74. More particularly, indentations 52 enable wall 74 to flex in ideal locations and keep wall 74 from pushing the golf club in an upward direction when the golf club continues through the swing plane and passes over said step golf tee 66.

Figure 15:
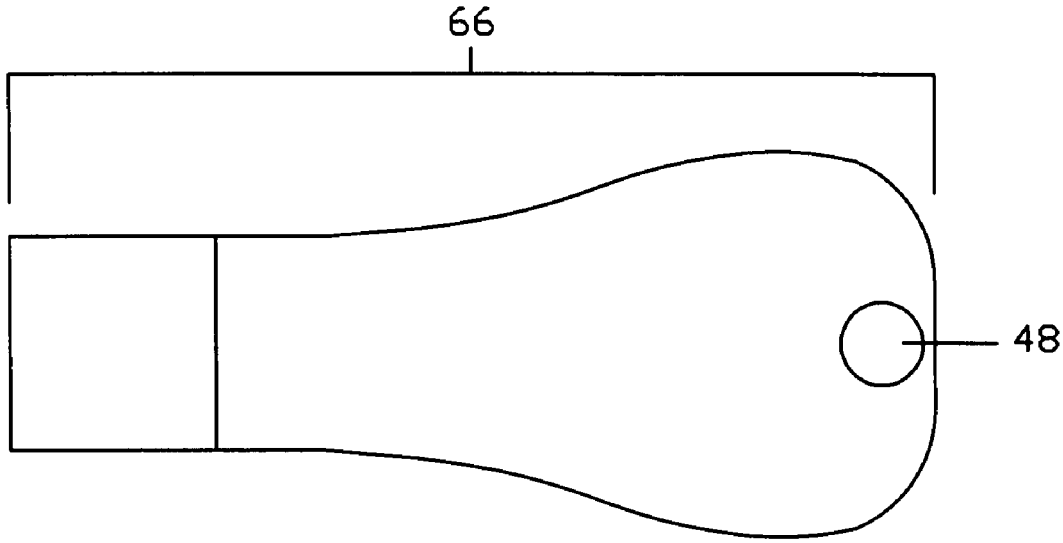
FIG. 15 is a top plan view of the step golf tee that slips through the insert in the mat.

FIG. 15 is a top plan view of step golf tee 66 and therefore includes a top plan view of cylindrical stem 48 at the leading end of said step golf tee.

Figure 16:
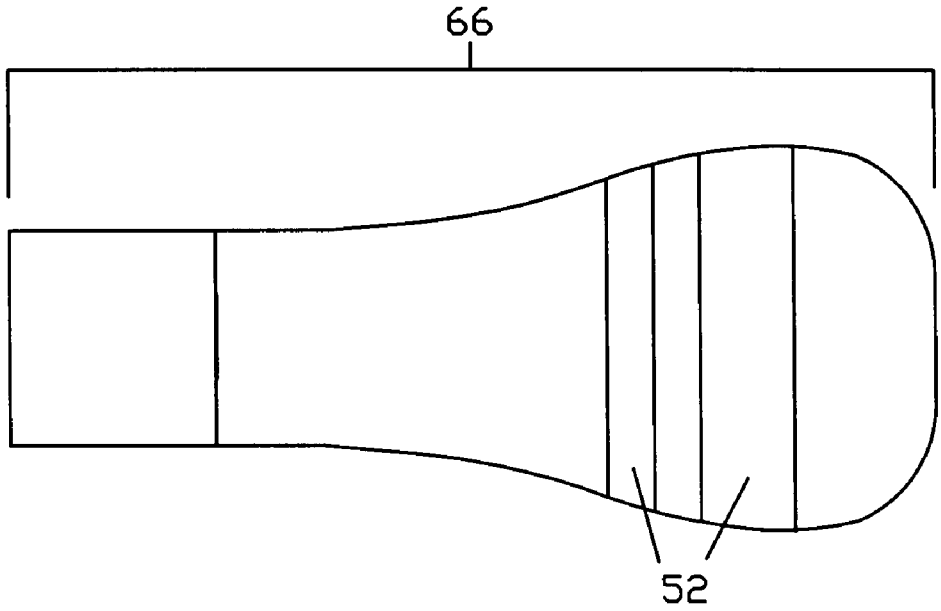
FIG. 16 is a bottom plan view of the step golf tee that slips through the insert in the mat.

FIG. 16 is a bottom plan view of step golf tee 66 and therefore includes a bottom plan view of indentations 52.

Figure 17:
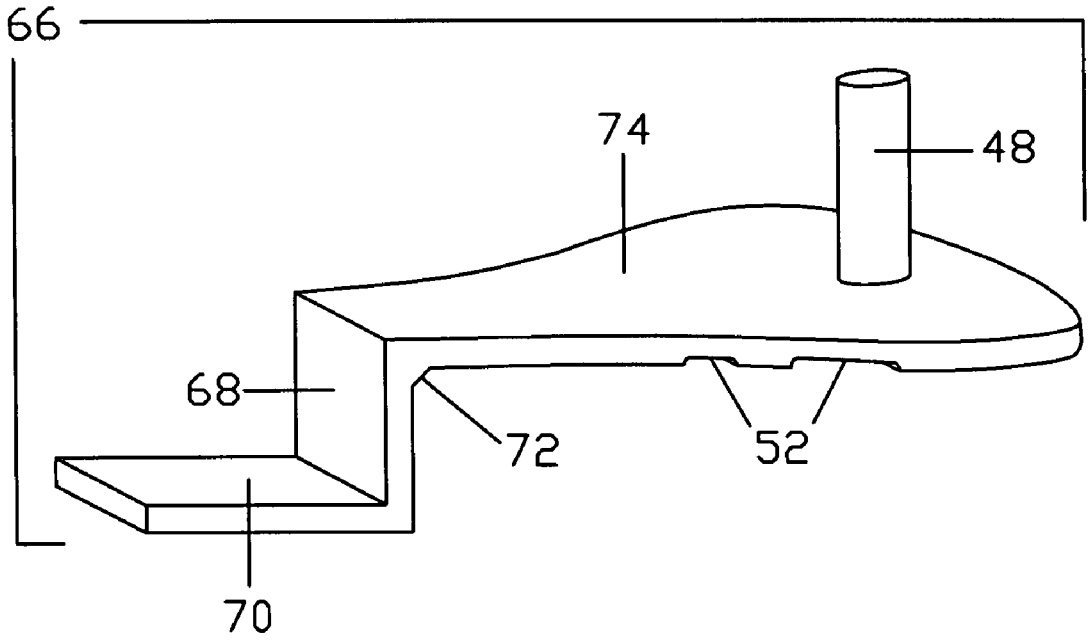
FIG. 17 is a perspective view of the step golf tee that slips through the insert in the mat.

FIG. 17 is a perspective view of step golf tee 66.

FIG. 18 is a side elevational view of insert 58.

FIG. 19 is a perspective view of insert 58. Rectangular slot 62 enables vertical wall 68 of step golf tee 66 to pass through golf mat 20. Beveled surface 64 matches up with outer bevel 72 to allow step tee 66 to lay flat when vertical wall 68 extends through rectangular slot 62 of insert 58.

More particularly, insert 58 is adapted to fit within the vertically-extending opening. Insert 58 has a top part, a middle part, and a bottom part that are integrally formed with one another. Vertically-extending rectangular slot 62 is formed in the middle part and is adapted to receive vertical interconnecting wall 68 that joins together elongate, flat top part 74 and truncate flat part 70.

The top part has a top wall and the middle part has a top wall. The respective top walls have a height differential substantially equal to a thickness of elongate, flat top part 74 of elongate step-shaped base 66 when said elongate step-shaped base is positioned within one of the recesses so that the top wall of the top part is substantially flush with a top surface of the elongate, flat top part 74 of elongate step-shaped base 66 when said elongate step-shaped base is positioned within one of the recesses.

The top part and middle part have co-planar bottom walls and the bottom part has a bottom wall. The co-planar bottom walls and the bottom part bottom wall have a height differential substantially equal to a thickness of truncate flat part 70 of elongate step-shaped base 66 when said elongate step-shaped base is positioned within one of the recesses so that the bottom wall of the bottom part abuts the support surface that supports the golf mat.

Figure 20:
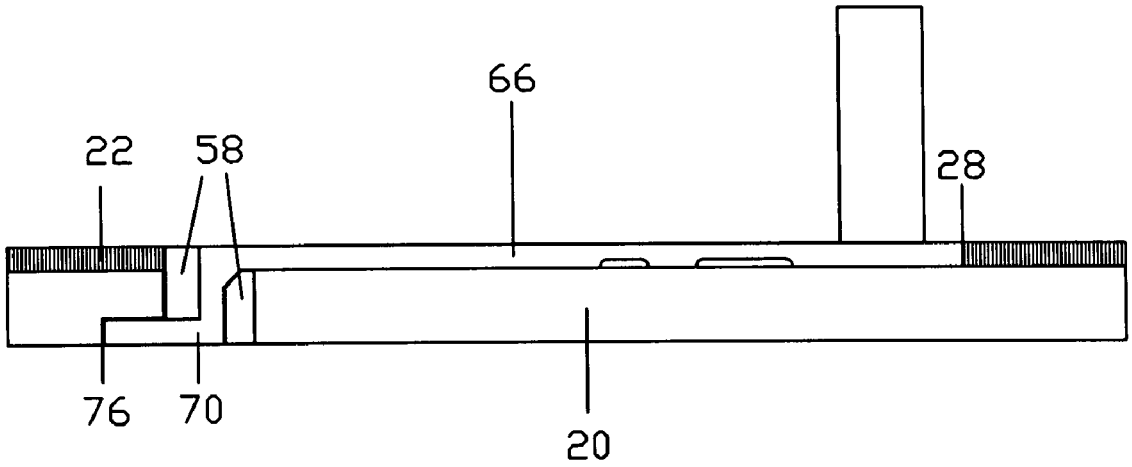
FIG. 20 is a cross-sectional view of a mat with an insert and the step golf tee.

A bevel is formed at an intersection of elongate, flat top part 74 and vertical interconnecting wall 68 as depicted in FIG. 20. Corresponding bevel 64 is formed in rectangular slot 62 at an upper end thereof so that said bevels flatly abut one another when the vertical interconnecting wall is fully received within the rectangular slot as depicted in FIG. 20.

FIG. 20 is a longitudinal cross-sectional elevational view of mat 20 having insert 58 in it to hold step golf tee 66. The top of said tee lies in recess 28 formed in artificial turf 22 and base wall 70 of step golf tee 66 lies in mat undercut 76 formed in the bottom of the mat.

Figure 21:
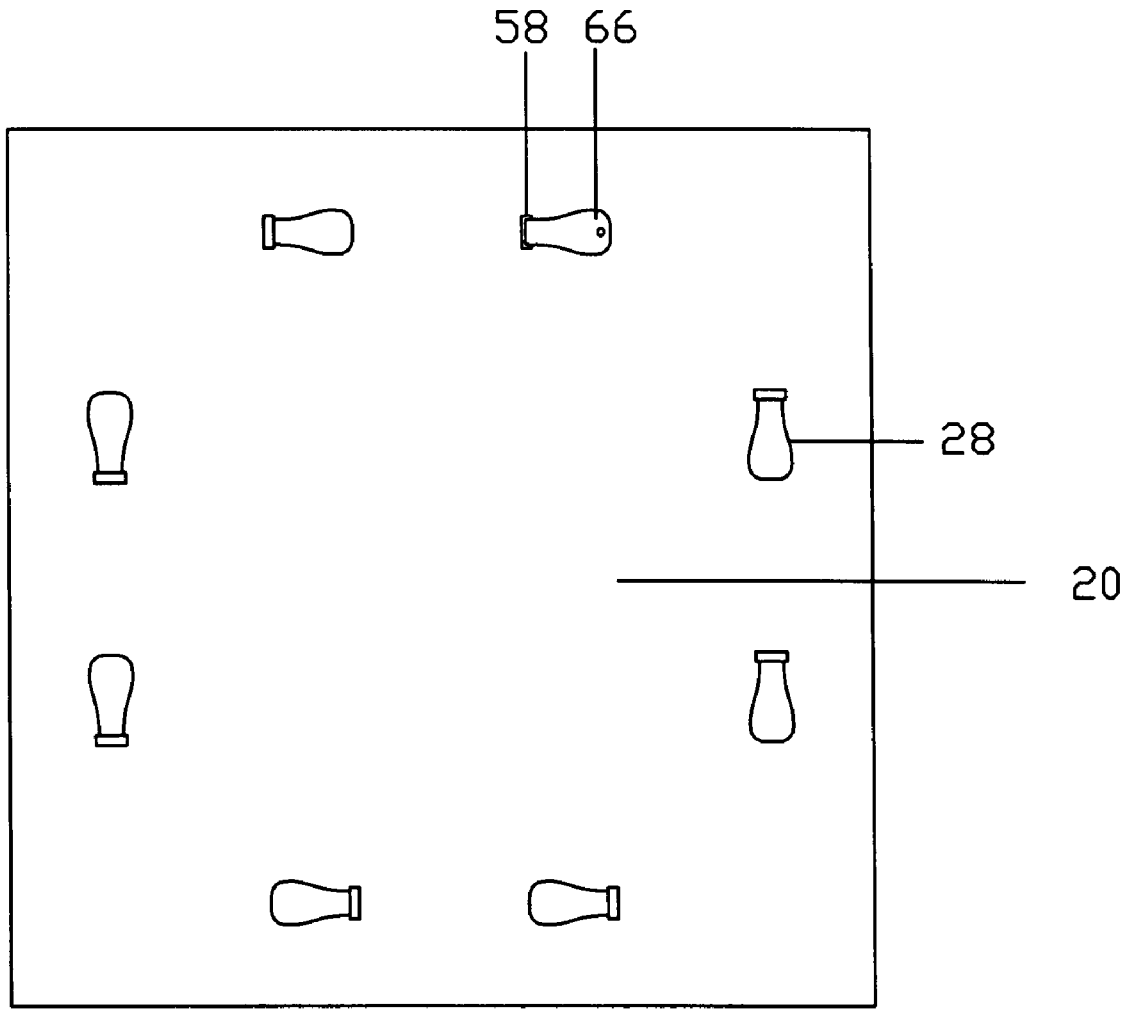
FIG. 21 is a top plan view of a mat including step golf tees and inserts.

FIG. 21 is a top plan view of mat 20 depicting step golf tee 66 inserted into insert 58 and lying in recess 28.

The novel mat can be made in various shapes such as, but not limited to, square, oval, triangular, hexagon, etc. Also the recessed shape can have many designs that will help in lowering the golf tee into the base of the mat, with some designs disclosed above. Furthermore the insert shape can be altered to improve the efficiency of the insert allowing for design freedom without altering its functionality.

I claim:

1. A golf mat and tee combination, comprising:

a golf mat having a foam base and an artificial turf disposed in overlying relation to said foam base;

a plurality of elongate, flexible flat bases, said elongate, flexible flat bases having a common configuration;

a plurality of recesses formed in said artificial turf, each recess of said plurality of recesses having a common configuration that corresponds to the common configuration of the elongate, flexible flat bases and each recess having a depth substantially equal to a height of said artificial turf so that said foam base is not covered by said artificial turf in said recesses;

each of said elongate, flexible flat bases having an upstanding tee mounted to a first end of its elongate, flexible flat base at a ninety degree angle to substantially eliminate pivotal movement between each upstanding tee and its associated elongate, flexible flat base, and a connecting means for securing said elongate, flexible flat base to the golf mat, said connecting means being positioned at a second end of said elongate, flexible flat base in laterally spaced relation to said upstanding tee;

an opening formed in said second end of each elongate, flexible flat base and said foam pad;

each elongate, flexible flat base of said plurality of elongate, flexible flat bases having a thickness substantially equal to said depth of said recesses so that a top surface of each elongate, flexible flat base is substantially coplanar with uppermost ends of said artificial turf when each, elongate, flexible flat base is positioned within its recess and when each elongate, flexible flat base is in a position of repose; and said connecting means extending through said opening formed in said second end of each elongate, flexible flat base and said foam pad, said connecting means being laterally spaced apart from said tee, said first end being free of any connecting means to the golf mat so that each elongate, flexible flat base flexes upwardly when its associated tee is struck by a golf club head.

2. The combination of claim 1, further comprising:

at least one indention formed in a bottom surface of each elongate, flexible flat base; and said at least one indention being transversely disposed with respect to a longitudinal axis of each elongate, flexible flat base;

said at least one indention enabling transient flexing of an elongate, flexible flat base when a golf tee rigidly mounted to said elongate, flexible flat base is struck by a golf club head during use of said golf mat, said transient flexing including a quick return of the elongate, flexible flat base to said position of repose.

3. The combination of claim 2, further comprising:

said connecting means including a connector member having a top part, a base, and a bolt for screwthreadedly interconnecting said top part and said base;

said connecting means including an elongate flat base bore formed in said elongate, flexible flat base at said second end thereof and a foam base bore formed in said foam base of said golf mat, said elongate flat base bore and said foam base bore being in axial alignment with one another;

said connecting means top part adapted to overlie said elongate flat base bore and said connecting means base adapted to underlie said foam base bore so that said second end of said elongate, flexible flat base and said foam base are disposed in sandwiched relation between said connecting means top part and said connecting means base when said bolt interconnects said connecting means top part and said connecting means base.

4. A golf mat and tee combination, comprising:

a golf mat having a foam base and an artificial turf disposed in overlying relation to said foam base;

said golf mat adapted to overlie a substantially flat support surface;

a plurality of elongate, step-shaped flexible bases having a common configuration;

a plurality of recesses formed in said artificial turf, each recess of said plurality of recesses having a common configuration that corresponds to the common configuration of the elongate, step-shaped flexible bases and each recess having a depth substantially equal to a height of said artificial turf so that said foam base is not covered by said artificial turf in said recesses;

a vertically extending opening formed in said golf mat at a preselected location in each of said recesses;

each elongate, flexible step-shaped base including an elongate, flexible flat top part adapted to overlie said golf mat, a truncate flat part adapted to underlie said golf mat, and a vertical interconnecting wall that extends through said vertically extending opening and that joins together said elongate, flexible flat top part and said truncate flat part;

an upstanding tee mounted to a first end of said elongate, flexible flat top part at a ninety degree angle to said elongate, flexible flat top part to substantially eliminate pivotal movement between each upstanding tee and its associated elongate, flexible flat top part;

said elongate, flexible flat top part and said truncate flat part being laterally spaced apart from one another so that said elongate, flexible flat top part flexes momentarily when a golf tee is struck by a golf club head;

each elongate, flexible step-shaped base being positioned in an associated recess and secured against movement therewithin by first inserting said truncate flat part through said vertically-extending opening, followed by rotating said elongate, flexible step-shaped base until said truncate flat part underlies said golf mat and said elongate, flexible flat top part overlies its associated recess, said vertical interconnecting wall being vertically disposed when said truncate flat part underlies said golf mat and said elongate, flexible flat top part overlies its associated recess.

5. The combination of claim 4, further comprising:

each elongate, flexible flat top part of said plurality of elongate, flexible step-shaped bases having a thickness substantially equal to said depth of said recesses so that a top surface of each elongate, flexible flat top part is substantially coplanar with uppermost ends of said artificial turf when said elongate, flexible step-shaped bases are positioned within respective recesses and when said elongate, flexible step-shaped bases are in a position of repose.

6. The combination of claim 5, further comprising:

at least one indention formed in a bottom surface of each elongate, flexible flat top part; and said at least one indention being transversely disposed with respect to a longitudinal axis of each elongate, flexible flat top part;

whereby said at least one indention enables transient flexing of each elongate, flexible step-shaped base when a golf tee is struck by a golf club head during use of said golf mat, said transient flexing including a quick return to said position of repose.

7. The combination of claim 4, further comprising:

an insert member adapted to fit within said vertically-extending opening;

said insert member having a top part, a middle part, and a bottom part that are integrally formed with one another;

a vertically-extending rectangular slot formed in said middle part;

said vertically-extending rectangular slot adapted to receive said vertical interconnecting wall that joins together said elongate, flexible flat top part and said truncate flat part;

said elongate, flexible top part having a top wall and said middle part having a top wall, said respective top walls having a height differential substantially equal to a thickness of said elongate, flexible flat top part of said elongate, flexible step-shaped base when said elongate, flexible step-shaped base is positioned within one of said recesses so that said top wall of said top part is substantially flush with a top surface of said elongate, flexible flat top part of said elongate, flexible step-shaped base when said elongate, flexible step-shaped base is positioned within one of said recesses;

said top part and said middle part having co-planar bottom walls and said bottom part having a bottom wall, said co-planar bottom walls and said bottom part bottom wall having a height differential substantially equal to a thickness of said truncate flat part of said elongate, flexible step-shaped base when said elongate, flexible step-shaped base is positioned within one of said recesses so that said bottom wall of said bottom part abuts said support surface that supports said golf mat.

8. The combination of claim 7, further comprising:

a bevel being formed at an intersection of said elongate, flexible flat top part and said vertical interconnecting wall;

a corresponding bevel being formed in said rectangular slot at an upper end thereof so that said bevels flatly abut one another when said vertical interconnecting wall is fully received within said rectangular slot.

* * * * *